US011193181B2

(12) United States Patent
Genaud

(10) Patent No.: US 11,193,181 B2
(45) Date of Patent: Dec. 7, 2021

(54) METHOD AND APPARATUS FOR CONTINUOUS THERMAL TREATMENT OF A STEEL STRIP

(71) Applicant: FIVES STEIN, Maisons Alfort (FR)

(72) Inventor: Alain Genaud, Malakoff (FR)

(73) Assignee: FIVES STEIN

( * ) Notice: Subject to any disclaimer, the term of this patent is extended or adjusted under 35 U.S.C. 154(b) by 293 days.

(21) Appl. No.: 16/027,980

(22) Filed: Jul. 5, 2018

(65) Prior Publication Data

US 2018/0312938 A1 Nov. 1, 2018

Related U.S. Application Data

(63) Continuation of application No. 15/101,137, filed as application No. PCT/IB2014/066380 on Nov. 27, 2014, now Pat. No. 10,041,140.

(30) Foreign Application Priority Data

Dec. 5, 2013 (FR) ..... 1362139

(51) Int. Cl.
*C21D 9/52* (2006.01)
*C21D 9/573* (2006.01)
(Continued)

(52) U.S. Cl.
CPC ..... *C21D 9/52* (2013.01); *C21D 1/60* (2013.01); *C21D 1/667* (2013.01); *C21D 6/00* (2013.01); *C21D 9/563* (2013.01); *C21D 9/573* (2013.01); *C21D 9/5737* (2013.01); *C21D 9/68* (2013.01); *C23C 2/02* (2013.01); *C23C 2/06* (2013.01);
(Continued)

(58) Field of Classification Search
None
See application file for complete search history.

(56) References Cited

U.S. PATENT DOCUMENTS 3,985,503 A 10/1976 O'Neal, Jr.
4,440,583 A 4/1984 Ikegami et al.
(Continued)

FOREIGN PATENT DOCUMENTS

EP 2103715 5/1983
EP 1108795 6/2001
(Continued)

*Primary Examiner* — Patricia L. Hailey
*Assistant Examiner* — Christopher D. Moody
(74) *Attorney, Agent, or Firm* — The Belles Group, P.C.

(57) ABSTRACT

Disclosed is a continuous thermal treatment line for a steel strip. The strip passes through consecutive thermal treatment chambers, is quickly cooled in at least one of the chambers by spraying liquid onto the strip, or by spraying a fluid made up of gas and liquid or spraying a combination of gas and liquid forming a mist. After quick cooling, a protective metal layer is deposited on the strip by dip coating. The cooling fluid strips iron oxides or other alloy elements contained in the steel to be treated, minimizing oxidation and reducing the oxides on the strip. Spray pressure and distance are chosen to facilitate the stripping property and the mechanical action of the sprayed fluid, reducing the layer of oxides on the strip. The temperature of the strip at the end of the cooling step is the temperature necessary for carrying out the desired treatment cycle.

3 Claims, 2 Drawing Sheets

(51) Int. Cl.

| | |
|---|---|
| ***C21D 1/60*** | (2006.01) |
| ***C21D 1/667*** | (2006.01) |
| ***C21D 9/56*** | (2006.01) |
| ***C23G 1/08*** | (2006.01) |
| ***C23G 3/02*** | (2006.01) |
| ***C21D 6/00*** | (2006.01) |
| ***C21D 9/68*** | (2006.01) |
| ***C23C 2/02*** | (2006.01) |
| ***C23C 2/06*** | (2006.01) |
| ***C23C 2/40*** | (2006.01) |

(52) U.S. Cl.

CPC ..... *C23C 2/40* (2013.01); *C23G 1/08* (2013.01); *C23G 1/088* (2013.01); *C23G 3/023* (2013.01); *C23G 3/027* (2013.01); *C23G 3/028* (2013.01)

(56) References Cited

U.S. PATENT DOCUMENTS

| | | | | |
|---|---|---|---|---|
| 4,561,911 | A | 12/1985 | Tanikawa et al. | |
| 5,137,586 | A * | 8/1992 | Klink | C21D 1/767 148/529 |
| 5,697,169 | A * | 12/1997 | Jacob | B21B 45/0233 134/199 |
| 6,126,891 | A * | 10/2000 | Jodet | C21D 9/561 266/46 |
| 8,425,225 | B2 * | 4/2013 | Pasquinet | C21D 11/00 148/511 |
| 8,918,199 | B2 * | 12/2014 | Claveroulas | C21D 1/667 700/147 |
| 9,109,833 | B2 * | 8/2015 | Delaunay | F26B 13/005 |
| 2001/0045024 | A1 | 11/2001 | Mignard et al. | |
| 2002/0124916 | A1 | 9/2002 | Pasquinet et al. | |
| 2009/0158975 | A1 | 6/2009 | Cluzel et al. | |
| 2009/0315228 | A1 | 12/2009 | Pasquinet et al. | |
| 2010/0044932 | A1 * | 2/2010 | Sugano | C21D 1/42 266/111 |
| 2010/0062385 | A1 * | 3/2010 | Pasquinet | C21D 9/56 432/8 |
| 2010/0186854 | A1 | 7/2010 | Bertrand et al. | |
| 2011/0266725 | A1 * | 11/2011 | Mehrain | C21D 9/46 266/44 |
| 2011/0270433 | A1 | 11/2011 | Claveroulas et al. | |
| 2012/0291679 | A1 * | 11/2012 | Giraud | F23N 3/00 110/186 |
| 2013/0029055 | A1 * | 1/2013 | Delaunay | F26B 13/005 427/444 |
| 2015/0013851 | A1 * | 1/2015 | Takahashi | C23C 2/02 148/508 |
| 2015/0140217 | A1 * | 5/2015 | Takahashi | C21D 1/74 427/321 |
| 2015/0140218 | A1 * | 5/2015 | Takahashi | C23C 2/02 427/321 |
| 2015/0167113 | A1 * | 6/2015 | Takahashi | C23C 2/02 118/68 |

FOREIGN PATENT DOCUMENTS

| | | | |
|---|---|---|---|
| EP | 1994188 | 11/2008 | |
| EP | 2376662 | 10/2011 | |
| FR | 2809418 | 11/2001 | |
| FR | 2903122 | 1/2008 | |
| FR | 2940978 | 7/2010 | |
| JP | S5891130 | 5/1983 | |
| JP | H02170925 | 7/1990 | |
| WO | WO2007096502 | 11/2007 | |
| WO | WO2010079452 | 7/2010 | |
| WO | WO-2011004302 A1 * | 1/2011 | C21D 9/565 |

* cited by examiner

METHOD AND APPARATUS FOR CONTINUOUS THERMAL TREATMENT OF A STEEL STRIP

PRIORITY

Priority is claimed as a continuation application to U.S. patent application Ser. No. 15/101,137, filed Jun. 2, 2016, which claims priority to international patent application No. PCT/IB2014/066380, filed Nov. 27, 2014, which claims priority to French patent application 1362139, filed Dec. 5, 2013. The disclosures of the aforementioned priority applications are incorporated herein by reference in their entirety.

The invention relates to annealing furnaces in continuous heat treatment lines for metal strips, mainly steel sheets, with annealing cycles that use cooling slopes.

This process is particularly suitable for hot-dip galvanizing lines or combined annealing and hot-dip galvanizing lines.

The process and the corresponding apparatus, according to the invention, make it possible to carry out heat treatment cycles comprising wet rapid cooling operations, capable of producing new steels, without requiring pickling of the strip after heat treatment.

The current lines for continuous annealing of metal strips, mainly steel strips, are composed of successive chambers in which the strip is first heated, then held at temperature for a variable time and finally cooled to almost ambient temperature in order to be able to be sold or to be subjected to a subsequent treatment. Other combinations of these heating, hold and cooling sequences may be carried out for more complex treatment cycles.

The lines according to the prior art, after carrying out a metallurgical annealing, are often used to produce a metal coating at the surface of the strip in order to increase its corrosion resistance. This treatment is generally carried out continuously, by dip coating into a bath of molten metal, for example of zinc, in order to galvanize the strip, capable of increasing the corrosion resistance of the final product, for example of automotive body parts. Mention may be made, as another type of treatment, of aluminizing or any other process for coating the strip with a metal alloy.

The automotive market is seeking to produce increasingly lighter bodies while maintaining or increasing their mechanical strength in the event of an impact in order to ensure the protection of their occupants. This preoccupation has led to two main production processes, one during the annealing heat treatment of the strip, the other during the stamping of the sheet to produce, for example, a vehicle body part.

The new heat treatment processes, for example for producing steels referred to as "martensitic" steels or "VHSS" (very high strength steel) steels, are based on an extremely rapid cooling of the steel after the heating and temperature hold phases, for example with cooling rates of greater than 200° C./sec, typically above 500° C./sec, and sometimes that may reach or exceed 1000° C./sec. These cooling slopes cannot be achieved with conventional cooling techniques by spraying a cooling gas onto the strip, the maximum cooling slopes close to 200° C./sec. It is then necessary to use cooling operations of water quenching type by spraying water or by spraying a mixture of gas and water onto the strip in order to produce these cooling slopes. It is then observed that even using treated water to achieve this cooling, depositions of oxides at the surface of the strip still occur which lead to the formation of defects during the hot-dip metal coating which may render the product unsuitable for its use by the current customers. The technique according to the prior art is therefore, after carrying out the rapid heat treatment cycle of the strip comprising a wet cooling operation, to cool the metal down to a temperature close to ambient temperature in order to carry out a chemical treatment for reducing the oxides at temperatures below around 100° C. which is considered to be a current temperature limit for carrying out this treatment. Specifically, the acids used for reducing the oxides present at the surface of the strip are very aggressive and it is sought not to form vapors that can be released into the production building and that can attack the peripheral equipment or create unacceptable working conditions for the operating staff.

After completion of the metallurgical annealing, the cooling and the chemical treatment for reducing the oxides, the strip is again heated to a temperature of around 460° C.-470° C. in order to be hot-dip galvanized in a line according to the prior art or galvanized on an electrogalvanizing line for certain applications, if its surface quality prohibits hot-dip galvanizing.

The succession of heating operations and cooling operations, in particular the rapid cooling operations with significant slopes create longitudinal and transverse stresses in the strip which may cause permanent deformations at the surface of the strip, deformations such as larger or smaller wrinkles or buckles. These deformations or wrinkles may cause surface defects on the strip by contact of the strip with furnace equipment, for example cooling boxes, and cause the finished product to be scrapped.

It is understood that the need to reduce the oxides formed by the wet rapid cooling, necessary for obtaining the mechanical characteristics desired for the product, leads to a significant loss of energy since it is necessary to cool the strip to ambient temperature in order to treat it chemically and then to reheat it to 460° C. in order to hot-dip galvanize it (coating with zinc, aluminum or other alloys) or to move the strip to another process line in the case of electrogalvanizing.

It is therefore impossible, for this type of treatment, to carry out all of the continuous annealing, pickling and galvanizing operations on a single line since it is necessary to cool the strip, treat it chemically at low temperature and then take it up again for the galvanization. These intermediate operations make the overall treatment of the steel longer and more expensive, especially in terms of energy.

Another solution for obtaining the desired mechanical properties on the strips has been developed by steelworkers. It consists in carrying out a complete heat treatment, similar to current cycles, which successively comprises the annealing and galvanizing operations, in order to then stamp these sheets, at temperatures close to 900° C. on special presses with the dies thereof maintained at temperature throughout the duration of the operation for forming the part. With this process, the annealing and galvanizing operations may be carried out with tools according to the prior art, but the pressing equipment is however very complex and requires reheating of the sheet which is also energy-consuming.

The invention proposed makes it possible to produce the very high yield strength steels expected by automobile manufacturers with a continuous process comprising wet rapid cooling operations; this process does not require the strip to be cooled to temperatures below 200° C. for the reduction of the oxides at temperatures below 100° C. but makes it possible to carry out the galvanization continuously on the same line and at the same speed as the annealing is carried out. This process eliminates the energy losses of the current techniques caused by this cooling to strip temperatures below 200° C. for a 1 mm thick strip in order to pickle the strip, enables a continuous operation without intermediate restart and provides the metal coating of the strip with the quality level provided by the current hot-dip metal coating techniques.

The invention proposes a process for the continuous heat treatment of a steel strip wherein:

- the strip passes through successive heat treatment chambers,
- a rapid cooling of the strip, in particular of greater than 200° C./sec, is carried out in at least one of the chambers by spraying liquid onto the strip, or spraying a fluid composed of gas and liquid or spraying a mist-type combination of gas and liquid,
- and, after the rapid cooling, a protective metal layer is deposited on the strip by dip coating, characterized in that:

- the fluid sprayed for the cooling is a fluid having a pickling property with regard to the iron oxides or oxides of other alloying elements contained in the steel to be treated, in order to limit the oxidation of the strip and reduce the oxides that have been able to be formed on the strip, in order to reduce or eliminate the surface defects during the hot-dip metal coating operation,
- the fluid is sprayed under a pressure and at a distance from the strip such that the combined effect of the pickling property and of the mechanical action of the sprayed fluid reduces the layer of oxides at the surface of the strip,
- and in that the temperature of the strip at the end of cooling is that needed to carry out the desired treatment cycle, in particular between 200° C. and 750° C., typically above 200° C.

The temperature at the end of cooling may be 460° C. if the cooling is the last step of the treatment cycle before coating the strip with a deposition of zinc according to the prior art. This temperature will be close to 200° C. if the heat treatment requires it for carrying out additional treatment phases which are carried out after the rapid cooling section.

Preferably, the liquid having a pickling property that is sprayed onto the strip is an acid solution having a pH of less than 5, in particular a solution of formic or boric acid or similar product.

The liquid sprayed onto the strip may comprise additives such as especially surfactants or wetting agents, for example perfluorononanoate, in particular acid inhibitors, especially benzotriazole or tetrazole.

Advantageously, the liquid supplies the nozzles which spray it onto the strip under a pressure of less than 1 bar for the low-pressure processes and under a pressure of greater than 5 bar for the high-pressure processes and at a distance from the strip of between 40 and 250 mm.

The heating zones located upstream of the rapid cooling zone may be in an atmosphere that is not very reducing, in particular with a hydrogen content of less than 5%, or in air, so that the formation of oxides is facilitated, the layer of oxides improving the efficiency of the heat exchanges in the heating chamber(s), and these oxides formed then being eliminated by the spraying of the cooling fluid, in order to attain the amounts of residual oxides that are compatible with the desired process or the desired quality of the product.

Advantageously the implementation of a system for controlling the parameters of the reduction process is provided, in particular the spraying of the fluid onto the strip in order to achieve the amounts of residual oxides that are compatible with the desired process or the desired quality of the product.

The strip length cooled by the cooling fluid may be adjusted as a function of the speed of the line or of the characteristics of the strip or of the inlet and outlet temperatures of the strip, in particular for adjusting the cooling slope as a function of the process or the heat cycle to be carried out. This results in a significant advantage which is the flexibility of the cooling rate (slow-rapid-ultra-rapid) and also the flexibility of the outlet temperature, two important points of heat treatment cycles carried out by and for steelworkers: a single system makes it possible to produce all sorts of current steels and not only new steels.

The cooling fluid is sprayed by nozzles onto the strip, and the process is characterized by the adjustment of the parameters for the cooling of the strip by adjusting the amounts of liquid injected onto the strip by each nozzle and for each section of the nozzle width in order to produce a theoretical cooling curve as a function of the metallurgical process to be carried out.

The process may comprise the implementation of an algorithm for calculating the risk of formation of wrinkles at the surface of the strip in order to adjust the longitudinal and transverse cooling slopes. On this subject, reference may be made to patent EP 10702917.5 published under the number EP 2 376 662, by the applicant company.

The invention also relates to a continuous heat treatment line for a steel strip, for the implementation of the process defined above, comprising:

- successive heat treatment chambers passed through by the strip,
- at least one of the chambers comprising means for rapid cooling, in particular of greater than 200° C./sec, these cooling means comprising nozzles for spraying liquid onto the strip, or spraying fluid composed of gas and liquid or spraying a mist-type combination of gas and liquid,
- and, after the chambers, equipment for depositing a protective layer on the strip, in particular hot-dip metal coating equipment, this line being characterized in that it comprises means for supplying the spraying nozzles with a liquid having a pickling property with regard to the iron oxides or oxides of other alloying elements contained in the steel to be treated, that have been able to be formed on the strip, in particular an acid solution having a pH of less than 5, and in that the nozzle supply pressure, and the distance from the nozzles to the strip are each sufficient independently of one another so that the combined effect of the pickling property and of the mechanical action of the sprayed liquid eliminates the layer of iron oxides or oxides of other alloying elements contained in the steel to be treated, which has been able to be formed on the strip, while retaining a strip temperature, at the end of cooling, which is high enough for the deposition of the protective layer.

The treatment zones located upstream of the rapid cooling zone may be in an atmosphere that is not, or not very, reducing, in particular with a hydrogen content of less than 5%, or in air in order to promote the formation of oxides on the strip during the heating, the reduction of these oxides being carried out by the spraying of the cooling fluid, in order to attain the amounts of residual oxides that are compatible with the desired process or the desired quality of the product.

Advantageously, the line comprises at least one atmosphere separation seal at the inlet and outlet of the cooling chamber in order to isolate this chamber, forming a wet zone, the upstream chamber and downstream chamber being in a dry atmosphere.

The control of the spraying nozzles may be provided by a checkerboard-type control algorithm that makes it possible to control the cooling of the section of strip present in the cooling zone along a direction parallel to the axis of the strip and a direction perpendicular to the axis of the strip in order to reduce the occurrence of deformations at the surface of the strip while producing the homogeneous metallurgical structure expected at the end of the heat treatment of the strip. On this subject, reference may be made to patent of the applicant company EP 00 403 318.9 published under the number EP 1 108 795, relating to cooling by check-pattern separated gas jets.

Advantageously, the line is equipped with a zone for rinsing the strip at the outlet of the rapid cooling zone.

The line may be equipped with air knives, atmosphere knives or liquid knives at the outlet of the wet cooling in order to limit the entrainment of liquid by the strip.

Each isolation seal may comprise a gas extractor device.

The process and the apparatus according to the invention make it possible to achieve slow, rapid or ultra-rapid cooling operations in a line, continuously, without oxidizing the strip and without polluting the upstream and downstream chambers of the line and without causing significant permanent deformation at the surface of the strip.

The line according to the process of the present invention comprises a rapid cooling zone able to achieve rapid cooling slopes, typically of beyond 500° C. or that may exceed 1000° C./sec carried out according to the prior art, for example according to the process described in patent FR 2 809 418 or patent FR 2 940 978. The pure or demineralized water used within the context of this process according to the prior art is replaced for example by a mixture of pure or demineralized water and of one or more acid(s) or a combination of acids and additives such as, for example, inhibitors which will reduce the oxides formed by the spraying of fluids onto the strip in order to implement a pickling process and/or a process for preventing the oxidation of the strip.

The presence of additives is not required since the acids and the residual organic compounds are destroyed by the temperature of the zinc bath. Inhibitors may however be used to limit the action of the acid following the attack of the oxides and to protect the support metal.

By this process, the presence of oxides at the surface of the strip has been greatly reduced or eliminated which makes it possible to produce the metal coating of the strip by dip coating on the same apparatus during the same process, without generating a coating defect with the current quality levels. Via this process, the cooling of the strip, according to the prior art for enabling the pickling thereof at low temperature, and the reheating thereof, from ambient temperature or close to ambient temperature for the coating, are no longer necessary. The annealing and galvanizing process is continuous. The significant loss of energy of the process according to the prior art is eliminated since the restarts to perform the different operations on different equipment are no longer required. The production of the metal coating by hot-dip galvanizing according to the current techniques makes it possible to retain the quality levels expected by the downstream industry, which was not the case with electrogalvanizing.

The invention consists, apart from the arrangements set out above, of a certain number of other arrangements that will be mentioned more explicitly hereinbelow with respect to exemplary embodiments described with reference to the appended drawings, but which are in no way limiting. In these drawings.

Figure 1:
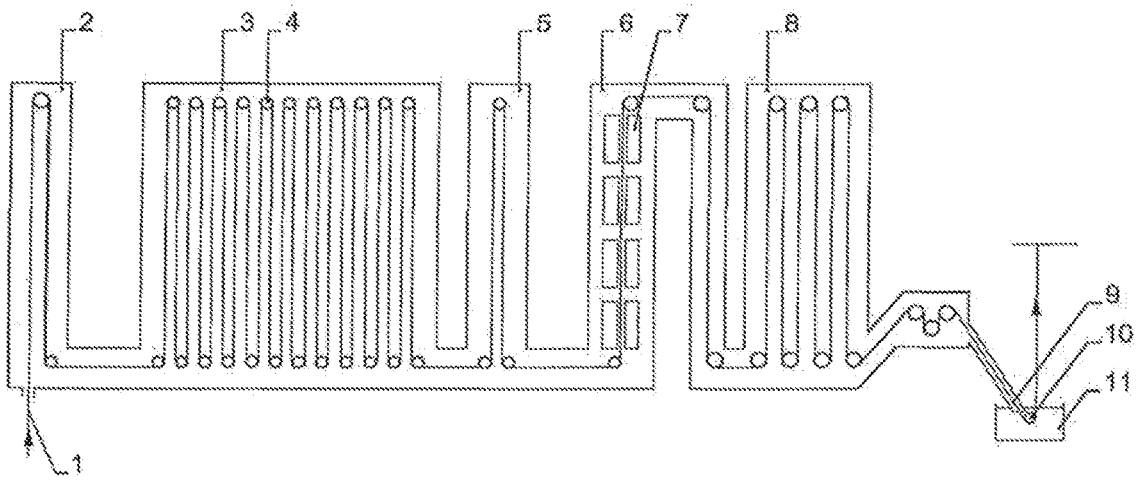
Fig. 1 (Prior Art)
FIG. 1 is a schematic view of a continuous line, according to the prior art, for the heat treatment of a steel strip.

FIG. 1 presents a vertical annealing-galvanizing line according to the prior art. It is understood that the same process may be carried out in a horizontal line.

The steel strip 1 passes successively through a preheating chamber 2 then a heating chamber 3 on sets of rollers 4. In this example, the strip then passes through the chamber 5 which corresponds to a slow cooling, the chamber 6 which corresponds to a conventional or rapid cooling by jets of gas on the strip from cooling boxes 7, and the chamber 8 which is a hold chamber. The strip is conveyed by an atmosphere sheath 9 and immersed at one of its ends into a bath of molten zinc or metals 11 via a roller 10.

The chambers for rapid cooling by spraying liquid onto the strip are isolated from the upstream and downstream chambers of the furnace by atmosphere separation seals. For the implementation of the process according to the invention, this tightness is reinforced in order to avoid the release of vapors, for example water and acid vapors present in the rapid cooling chamber, in particular by the use of seals 14, 17 (FIG. 2) as described in FR 2 903 122 or comparable technologies. The function of these seals is to separate the atmosphere of the wet cooling chamber from the upstream and downstream chambers and to limit the passage of an atmosphere containing vapors of acids or of chemical compounds used for reducing the oxides present at the surface of the strip. Atmosphere outlets 13, 16 (FIG. 2) make it possible to discharge the acid vapors to a retreatment system external to the cooling zone.

It is also understood that the line implementing the process according to the invention is equipped with a circuit (not represented) for treating the cooling liquid of the type known for the cooling, and the separation of the chemical products formed by the reduction of the oxides and also of the optional foreign substances, but also with specific equipment (not represented) for controlling the composition of the cooling liquid, especially the pH value as a function of the condition of the strip and its degree of oxidation at the inlet of the cooling zone.

The wet rapid cooling zone with acid or corrosive solutions present is made from materials that are resistant to these chemical compounds, in the liquid phase or in the vapor phase, especially stainless steels or synthetic materials for the feed and return pipework of the cooling products.

Rapid cooling operations such as those carried out in the invention cause significant stresses that may lead to permanent deformations being produced at the surface of the product, these deformations possibly being unacceptable for the production of products of commercial quality.

According to the invention, the portion of the strip present in the cooling zone is partitioned (FIG. 3) by the calculation along the length of the strip and its width, each of the boxes thus obtained is the subject of a determination of the stresses in the material caused by the cooling in order to verify whether these stresses are below the limit permissible by the material. On this subject, reference may be made to EP 1 994 188/WO 2007/096502 in the name of the applicant company. The result of this calculation is delivered to the computer (not represented) of the line in order to adjust the cooling parameters such as the speed of the cooling gas and the amount of water or liquid sprayed onto the strip. By this means, each portion of the strip is the subject of a cooling optimization calculation in order to meet the metallurgical objectives without causing to permanent deformation at the surface of the strip.

Figure 2:
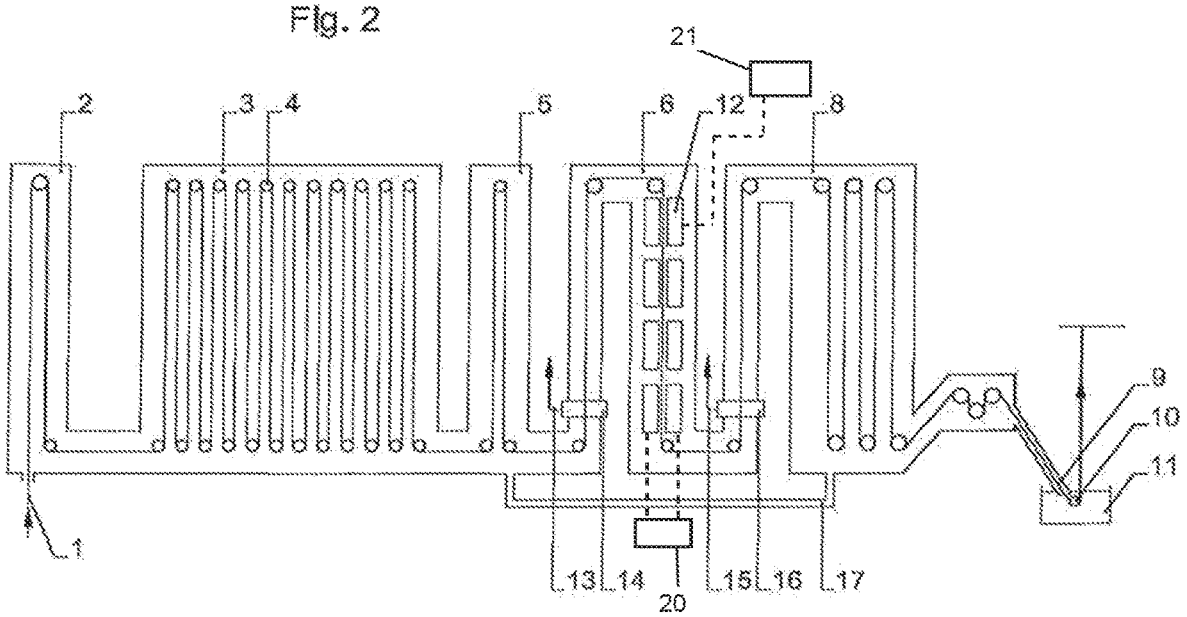
FIG. 2 is a view similar to FIG. 1 of a continuous line, according to the invention, for the heat treatment of a steel strip.

FIG. 2 presents a vertical galvanizing line according to the invention. The chambers upstream and downstream of the rapid cooling zone 6 are unchanged, with respect to FIG. 1.

The rapid cooling zone 6 is isolated from the upstream chamber 5 and downstream chamber 8 by seal 14 and 16 according to known technologies, in particular according to FR 2 809 418 with a gas outlet 13 and 15 intended to guarantee the absence of communication between the atmospheres of the wet cooling chamber 6 and the upstream and downstream chambers.

A communication tunnel 17 between the chambers 5 and 8 upstream and downstream of the rapid cooling chamber 6 makes it possible to prevent communications of atmospheres between these chambers in the case where there is a pressure difference between the chambers 5 and 8.

The rapid cooling of the strip 1 is obtained by spraying a liquid from a source of a liquid 21 onto the strip, by a combination of spraying liquid through a series of nozzles (not visible) and atmosphere through an independent series of nozzles or by creating a mixture of atmosphere and of liquid through a series of combined nozzles. This apparatus is represented by the boxes 12 positioned along the strip over a vertical line, the strip preferably running vertically from top to bottom so that the gravity flow of the cooling liquid can take place at the coldest strip temperatures.

Each of the cooling processes listed above is equipped with means for regulating their effectiveness which make it possible to control the coefficient of heat exchange with the strip as a function of its temperature, of the type of cooling curve to be achieved in order to obtain the desired metallurgical structure and to avoid the formation of surface defects such as wrinkles or buckles.

Figure 3:
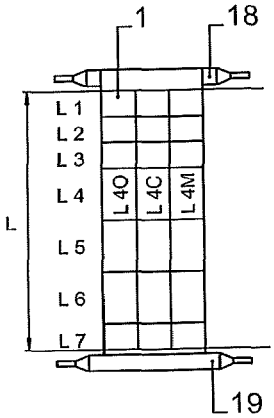
FIG. 3 is a front view of a vertical portion of the steel strip with checkerboard-type zones for a control of the spraying nozzles provided by a control algorithm.

FIG. 3 presents the operating principle of this system for controlling the cooling of the strip. Seen in front view is the portion of the strip 1 present in the rapid cooling zone 6 with the upper roller 18 and lower roller 19. On this strip section, a portion denoted by L corresponds to the zone of the cooling boxes. This length L is divided vertically into a plurality of segments L1, L2 . . . L7 in this example and horizontally into three portions: O for the operator side, C for the center and M for the motor side. This gives, in this example, the zones L4O, L4C and L4M. The number of horizontal and vertical zones is not limited, each zone may have a dimension different from the other zones in order to correspond to the arrangement of the cooling boxes, of irregularities such as in particular the presence of stabilizing rollers, or for enabling a greater precision of control, especially in the zones where the risk of formation of wrinkles or buckles on the surface of the strip is high.

The cooling means are designed so as to correspond to the cutting into zones of the cooled portion of the strip, especially with control valves controlled by the control system 20 (shown in FIG. 2) of the line in order to adjust the pressure or the flow rate of the liquid as a function of the exchange coefficient to be obtained.

The control system 20 comprises a set of algorithms for calculating the stresses induced in the material of the strip as a function of the desired cooling, for example for passing a strip from a temperature of 850° C. to 470° C. in around 1.5 seconds, and will optimize the cooling curve in order to limit the stresses in the strip during this cooling.

Figure 4:
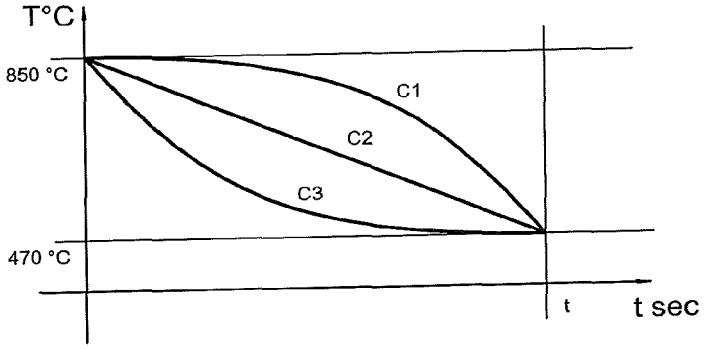
FIG. 4 is a graphical representation of various cooling curves of the strip, the time being given on the abscissa and the strip temperature on the ordinate.

FIG. 4 presents this type of cooling between 850° C. and 470° C. over a time t:

- the curve C1 shows small cooling slopes for the high temperatures close to 850° C. and larger slopes for temperatures close to 470° C.;
- the curve C2 shows a linear cooling slope between the starting temperature of 850° C. and the final temperature of 450° C.; N.B. or less if the thermal cycle makes it necessary;
- the curve C3 presents larger cooling slopes for the highest temperatures close to 850° C. and smaller slopes close to 470° C.

The longitudinal cooling curve may thus be optimized in order to control the actuators, and the liquid spray nozzles, equipping the zones L1 to L7 in order to obtain the final result without causing to surface defects on the strip.

Similarly, the transverse temperature profile of the strip, for example at the furnace inlet or cooling section inlet, may be integrated into the calculation in order to control the actuators and the nozzles of the transverse zones in order to compensate for a pre-existing profile or to deliberately create a desired temperature profile on the strip.

Temperature measurement means (not represented) may be used upstream or downstream of the cooling zone by the control system of the furnace in order, especially, to compensate for a temperature level or profile existing at the inlet of the cooling zone or, by measurement at the outlet of this cooling zone, to modify the setpoints of the actuators for obtaining the required effect.

According to one variant of implementation of the invention, the effectiveness of the pickling and of the reduction of the oxides obtained owing to the implementation of the process is taken into account. It becomes possible to let the heating zones, corresponding to the chambers 3 and 5, with atmospheres that are less developed, for example with a smaller content of hydrogen typically of less than 5%, and that are therefore less reducing, optionally even in air. The surface oxidation of the strip obtained during the heating is facilitated in these less reducing atmospheres, and has the effect of increasing the emissivity coefficient of the strip which increases the effectiveness of the radiant heating and makes it possible to reduce the size and the cost of the apparatus. Such a line will be more compact and therefore have a lower investment cost and a lower operating cost while enabling the production of improved steels with respect to the prior art.

The invention may be used on an annealing line, even if the constraint of galvanization is not present. The advantages of the in-line pickling, and the possibilities of atmospheres that are less developed in the heating zones will however remain present in this type of apparatus.

The invention claimed is:

1. A continuous heat treatment line for a steel strip, comprising:

a source of a cooling liquid having a pickling property with regard to iron oxides or oxides of other alloying elements contained in the steel strip to be treated, the cooling liquid being an acid solution having a pH of less than 5;

successive heat treatment chambers passed through by the steel strip, at least one of the heat treatment chambers comprising a rapid cooling zone configured to cool the steel strip at a rate greater than 200° C/sec, the rapid cooling zone comprising nozzles, wherein the nozzles are configured to spray a cooling fluid comprising one of the cooling liquid, a combination of a gas and the cooling liquid, or a combination of gas and the cooling liquid in a mist form onto the steel strip such that a mechanical action of the cooling fluid in combination with the pickling property of the cooling liquid is sufficient to eliminate a layer of iron oxides or oxides of other alloying elements contained in the steel strip to be treated, which has been able to be formed on the steel strip, while retaining a strip temperature above 200° C. at an end of cooling in the rapid cooling zone; and hot-dip metal coating equipment receiving the steel strip after the steel strip leaves the rapid cooling zone, the hot-dip metal coating equipment depositing a protective layer on the steel strip.

2. The continuous heat treatment line as claimed in claim 1, wherein the nozzles are configured to spray the cooling fluid along a direction parallel to a longitudinal axis of the steel strip and a direction perpendicular to the longitudinal axis of the steel strip in order to reduce an occurrence of deformations at a surface of the steel strip.

3. The continuous heat treatment line as claimed in claim 2 wherein a strip section of the steel strip located within the rapid cooling zone is divided into a plurality of zones that are arranged in a plurality of columns and a plurality of rows, and wherein each of the nozzles is associated with one of the plurality of zones.

* * * * *